US006000536A

United States Patent [19]

Piotrowski

[11] Patent Number: 6,000,536

[45] Date of Patent: Dec. 14, 1999

[54] BOTTLE PACK CONTAINER

[76] Inventor: Zygmunt Piotrowski, Ul Keniga 4 M. 48, Warsaw, Poland, 02-495

[21] Appl. No.: 09/147,360

[22] PCT Filed: Jun. 5, 1997

[86] PCT No.: PCT/PL97/00012

§ 371 Date: Dec. 7, 1998

§ 102(e) Date: Dec. 7, 1998

[87] PCT Pub. No.: WO97/46464

PCT Pub. Date: Dec. 11, 1997

[51] Int. Cl.[6] ..... B65D 75/00

[52] U.S. Cl. ..... 206/198; 206/188; 206/197; 206/427

[58] Field of Search ..... 206/139, 147, 206/148, 168, 188, 197, 198, 427

[56] References Cited

U.S. PATENT DOCUMENTS

| | | | |
|---|---|---|---|
| 1,981,647 | 11/1934 | Johnson | 206/427 |
| 2,298,191 | 10/1942 | Boh | 224/45 |
| 2,336,857 | 12/1943 | Gies et al. | 206/168 |
| 2,397,716 | 4/1946 | Wendler | 206/148 |
| 2,430,302 | 11/1947 | Ringler | 206/427 |
| 2,676,731 | 4/1954 | Klein | 220/113 |
| 5,052,552 | 10/1991 | Maroszek | 206/174 |

FOREIGN PATENT DOCUMENTS

| | | |
|---|---|---|
| 2 235 846 | 1/1975 | France . |
| 175885 | 8/1996 | Poland . |

*Primary Examiner*—David T. Fidei

*Attorney, Agent, or Firm*—Jacobson, Price, Holman & Stern, PLLC

[57] ABSTRACT

A bottle pack container for carrying bottles with contents, preferably made of cardboard or pasteboard, formed from two symmetrical carrying parts with central walls superimposed so as to form the central portion of the container, the central walls having openings superimposed and fastened by a lock to form a grip. Each of the carrying parts comprises at least one partly cut ring with an internal cut-out opening and with lateral wings and frontal wing, wherein said ring is attached to the inner surface of the external wall with glue. During assembling of the container the girded polypropylene strap is inserted into the appropriate holes provided in the external walls of each of the carrying parts.

17 Claims, 2 Drawing Sheets

BOTTLE PACK CONTAINER

BACKGROUND OF THE INVENTION

1. Field of the Invention

The subject of the invention is a bottle pack container, especially for bottles with contents, preferably made of cardboard or pasteboard.

2. Description of the Related Art

Known from the disclosure of Polish Patent Application P. 307 276 by the same applicant is the container for carrying bottles with contents, preferably made of cardboard or pasteboard, formed from a belt comprising two carrying parts symmetrical about the transverse axis, along which a fold runs, each of the carrying parts with the central wall fitted with a grip opening and a lock hole, said central wall being separated by a fold from the bottom wall which is in turn separated by the fold from the face wall fastened to the central wall by means of clamping arms, whereas the clamping arms are formed by bending the arms of the face wall along two folds, then by bending these arms around the container edges, finally threading ends of said arms through the lock hole and, finally, by bending the belt of the carrying parts along the fold on the symmetry axis to form the container.

The solution according to that invention has a disadvantage that the belt comprising two carrying parts is too long with regard to the width, thereby posing technological problems. Moreover, the container must be delivered to the work station where bottles are packed, in a completely assembled shape and thus in a stiff three-dimensional state. Still another drawback of this solution is the lack of partitions between bottles causing them to bang against each other during transport. Also, the inability of stable holding of more than four bottles only in the container is another serious disadvantage.

Known from the disclosure in the U.S. Pat. No. 2,298,191 the bottle carrier, made from one single paperboard blank, is formed from a pair of panels, each one with central wall superimposed to form the container hanger, the top wall provided with perforations to form sockets to accommodate the bottles therein, and side wall connected with the bottom wall that is common for both panels. The hanger is fastened with a lock to form a grip, and the central walls comprise tongues cut therein, each provided with an internal cut-out opening which, when set up, retain the neck of each bottle in position.

A disadvantage of this known solution is that, to hold the bottle in position, it is necessary to engage the cut-out openings made in two different walls: one in the top wall with the bottle body, and the other in the tongue of the central wall with the bottle neck.

Another disadvantage is that the openings in the top walls to accommodate bottles therein are spaced at a distance that is necessary to keep said top walls rigid, yet the bottles are too much apart so that the whole container becomes too long.

Still another disadvantage is that two rows of bottles are supported on a single bottom wall, which makes an excessive load weight acting on the container bottom.

SUMMARY OF THE INVENTION

The purpose of the invention disclosed in this specification is a bottle pack container which would be free of the disadvantages of the prior-art solutions described.

Another purpose of the invention is a commercially attractive bottle pack container and thus suitable for an automated packaging line.

These purposes have already been achieved by the bottle pack container, especially for bottles with contents, preferably made of cardboard or pasteboard, comprising two symmetrical carrying parts with central walls superimposed so as to form the central portion of the container, the central walls having superimposed openings fastened by a lock to form a grip. Each of the carrying parts comprise also a bottom wall and an external wall being an external portion of said part.

According to this invention, each of the carrying parts includes a ring cut therein, connected to said part along a first fold and provided with an internal cut-out. The ring has a frontal wing bent along second folds with regard to the base of said ring, said ring having a tab located between said second folds and extending said frontal wing over to the other side of the line defined by said second folds. Said frontal wing and said tab are fixed to an external portion of the carrying part. According to the invention, the ring has also two lateral wings bent along the folds with regard to the base of said ring.

Each of the carrying parts of the container, comprising the central wall, the bottom wall, and the external wall, has two holes symmetrically disposed in said external wall, wherein each of the holes is connected with the side edge of said external wall through a cut and two folds. Preferably the holes are rectangular.

In a variant of this embodiment, each of the carrying parts additionally include at least one ring cut therein which is provided with an internal cut-out.

In another variant of the embodiment, each carrying part includes at least one half-ring cut therein, formed by dividing the ring with regard to its symmetry axis, provided with an internal cut-out opening.

The ring fixed to an external portion of the respective part being provided with an internal cut-out forms a bottle socket, preventing its displacement along the bottom, and the bending of the lateral wings of said ring facilitates proper separation of adjacent bottles in the row. After loading the bottle pack, a girded strap is blown into the holes in external walls, wherein a cut with two folds connecting each hole with the external wall side edge forms an elastic trap preventing the subsequently welded girded strap from falling out from its seats, also after emptying the container and collapsing it flat.

The girded strap threaded through the holes in the external walls of both carrying parts assembles the bottle pack container and stabilizes the set of the bottles carried. The use of a girded strap efficiently eliminates the need for the container clamping arms, simplifying the outer shape of the carrying parts blank, and reducing its length and width to an essential minimum.

The bottle container according to the invention is characterized by low materials consumption, easy servicing and increased facility of lifting the bottles, thereby effectively increasing its market attractiveness. The technique requiring a single move only to set the container up, one move to pack it with bottles, as well as the high speed of horizontal strapping machines, guarantee commercial attractiveness of the invention, which is particularly useful for a heavy load of reusable thick-glass bottles with contents.

BRIEF DESCRIPTION OF THE DRAWINGS

The subject of the invention is shown in embodiments on the drawing, in which.

DETAILED DESCRIPTION OF THE PREFERRED EMBODIMENT

Figure 1:
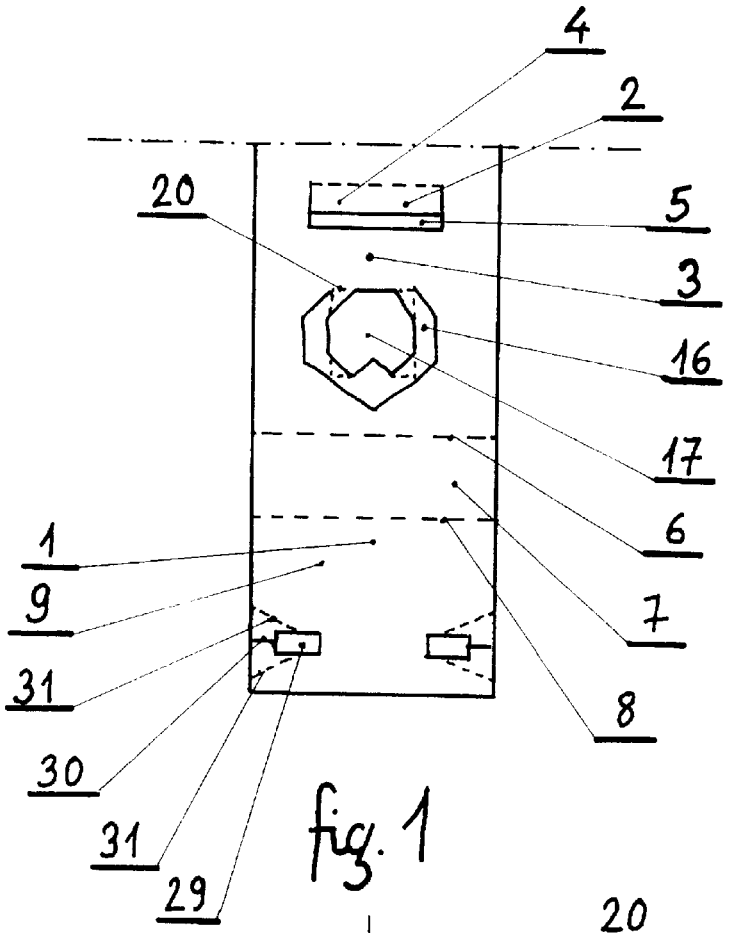
FIG. 1 shows the bottle pack container, whereof one of the carrying parts is shown expanded on a flat surface, FIG. 2 show the ring with wings expanded on a flat surface.

The container is assembled of two identical carrying parts 1 (FIG. 1). Each of said carrying parts 1 contain a lock 2 which serves to connect the two carrying parts 1 with each other, a central wall 3 with a grip 4 fitted with an opening 5. Two carrying parts 1 with central walls 3 and said openings 5 are superimposed to form the central portion of the container.

The central wall 3 is connected to the bottom wall 7 along a fold 6 and the bottom wall 7 is connected along fold 8 to the external wall 9. The external walls 9 of carrying parts 1 form the external portions of the container.

Figure 2:
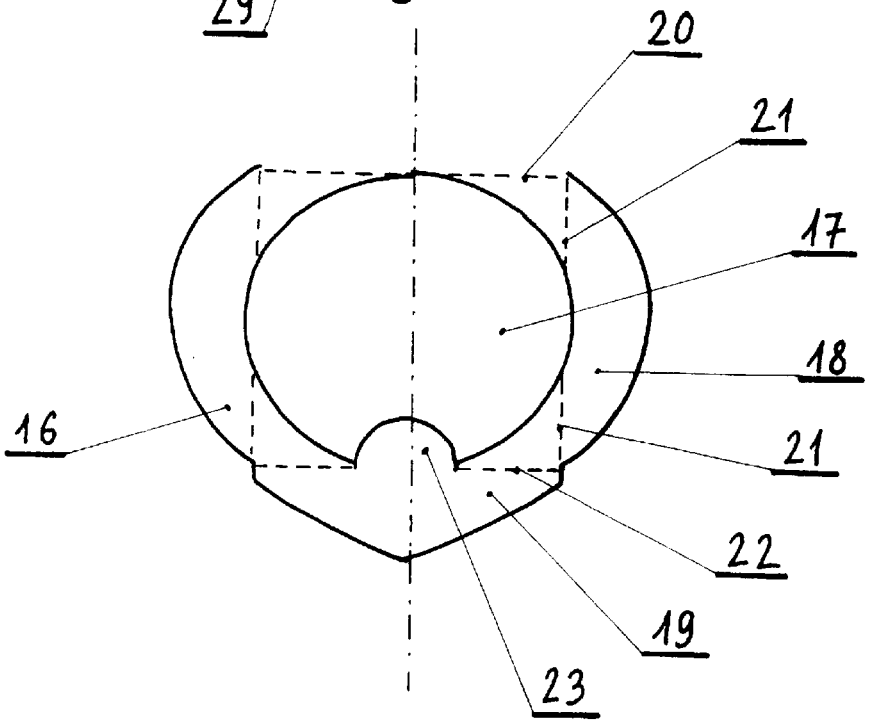
Figure 3:
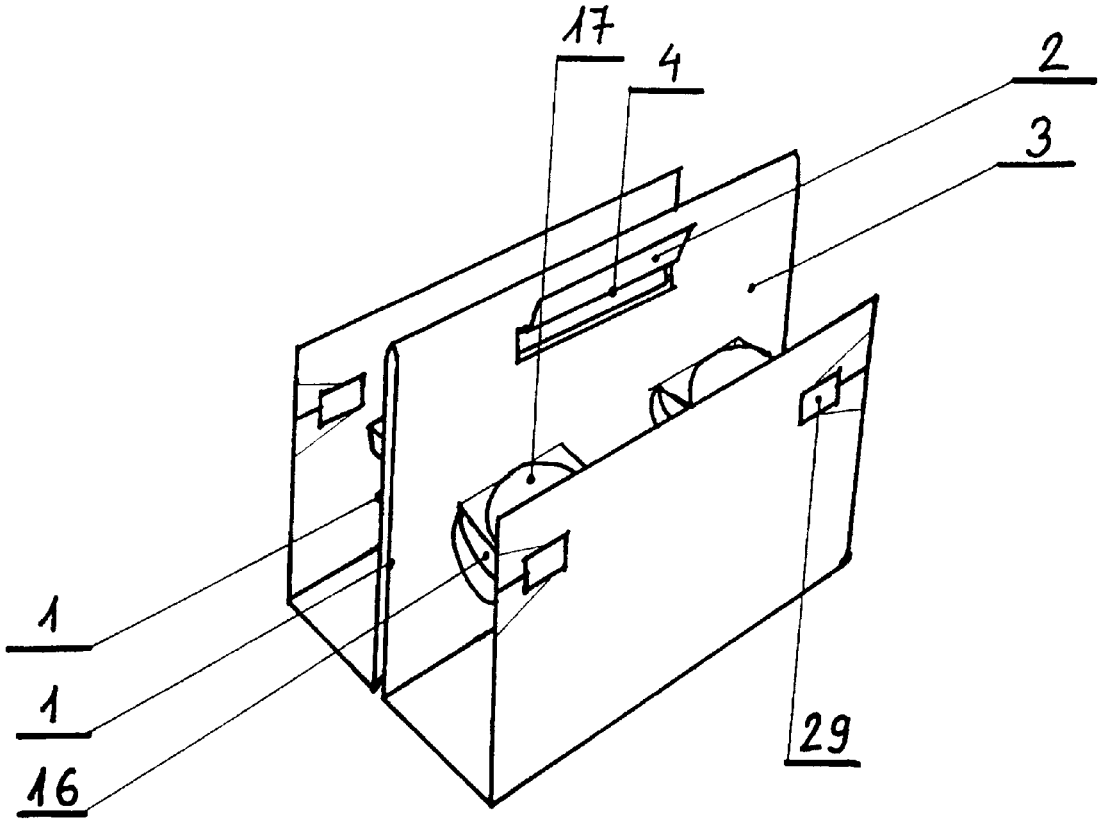
FIG. 3 shows the container in a set up state ready to be packed with bottles, in a perspective view.

Each carrying part 1 with central wall 3 includes at least one ring 16 cut therein (FIG. 2), provided with an internal cut-out 17, said ring 16 has two lateral wings 18 and a frontal wing 19. The ring 16 has a first fold 20 along which said ring is connected to the central wall 3, two other folds 21 along which said lateral wings 18 are connected to said ring 16, and folds 22 along which said frontal wing 19 is connected to said ring 16. The frontal wing 19 contains a tab 23 located between said folds 22 and extending from said frontal wing 19 on the other side of the line defined by said folds 22. To assemble the container, the frontal wings 19 and the tabs 23 of all the container rings 16 are fastened to the external portions 9 of the respective parts 1 (FIG. 3).

Each of the carrying parts 1 has two symmetrically disposed holes 29 cut out in the external wall 9 said holes 29 may be of just any shape, but preferably rectangular. Each of the holes 29 is connected with the side edge of the external wall 9 through a cut 30 and two folds 31 situated on both sides of said cut 30, as depicted in FIG. 1.

To form the container, first into a flat construction, the following operations are carried out in a sequence: the external portions of two carrying parts are bent along the folds 8 by pressing on the reverse of an external wall 9 towards the previously glued frontal wings 19 and tabs 23. Next, said two carrying parts 1 are superimposed to form the central portion of the container by threading lock 2 through the superimposed openings 5, thereby forming grip 4 of the flattened container.

Subsequently, the container is formed into a three-dimensional construction in one move by opening the bending angle of both carrying parts 1 along folds 8, preferably by an angle of 90 degrees, whereby simultaneously bends are formed along folds 6, 20 and 22. Under the weight of the bottles being placed the outside said ring 16, lateral wings 18 are deflected downwards along folds 21 to form a right angle to the base of said ring 16, and the complete construction is made stiff by being pushed outwards by the bulk of the inserted bottles. While blowing the strap, preferably of polypropylene, into holes 29 and welding its ends to make a girth fastening, the strap is pushed through cuts 30 into holes 29 being guided to its proper position through springing and trapping folds 31 located on both sides of each cut 30.

By adding more, at least one, ring 16 after a suitable extension in width of each of the carrying parts 1, ten or more bottles can be packed into one container. By making a half-ring formed by dividing ring 16 with regard to the symmetry axis, after a suitable reduction in width of each of the carrying parts 1, four bottles can be packed into the container.

The above solutions are applicable as the bottle pack container, especially for heavy glass bottles filled with beer, wine of other beverages. In such a container the height of the central portion of the container is preferably equal to, or lower than the height of the bottle placed in the container, which enables quick placement of the containers into rows, layers and stacks.

The above solutions are also applicable as containers for other than bottle type packings, especially of round shape, as jars, cans or bags.

What is claimed is:

1. A bottle pack container comprising two carrying parts, each of said two carrying parts having a central wall, a bottom wall and an external wall, the central walls superimposed to form a central portion of the container, the central walls having superimposed openings fastened together by a lock to form a grip, each respective carrying part of said two carrying parts including a ring cut therein connected to said respective carrying part by a first fold and provided with an internal cut-out, said ring having a frontal wing bent along second folds that define a line that is parallel to the first fold, along a base of said ring, and also a tab located between said second folds and extending said frontal wing past the line defined by said second folds into the internal cut-out of said ring, said frontal wing and said tab being fixed to an internal surface of a respective external wall.

2. The container according to claim 1, wherein the ring has two lateral wings, each of said two lateral wings folding at a right angle with regard to the line defined by said second folds along the base of said ring.

3. The container according to claim 1, wherein each respective carrying part comprising the central wall, the bottom wall and the external wall has two holes symmetrically disposed in the external wall, wherein each of said holes is connected through a cut with a side edge of the respective carrying part.

4. The container according to claim 3, wherein each hole is connected through folds with the side edge of the respective carrying part.

5. The container according to claim 3, wherein the holes are rectangular.

6. The container according to claim 3, further comprising a strap encircling the two carrying parts, the strap passing through the cuts and into the holes and connected at its ends to form a girth fastening.

7. The container according to claim 1 wherein the container is made of one of cardboard and pasteboard.

8. A bottle pack container comprising two carrying parts, each of said two carrying parts folding to form a central wall, a bottom wall and an external wall, the two central walls superimposed to form a central portion of the container having an opening therethrough to form a grip, each external wall folding upward to be essentially parallel to the central portion, each respective carrying part of said two carrying parts having a ring cut therein which is connected to the respective carrying part by a first fold, the ring including an internal cut-out, sized to receive a bottle, and a frontal wing bent along a second fold, the second fold being essentially parallel to the first fold, the bent frontal wing for securing the ring to an inner surface of a respective external wall, each external wall including two symmetrically arranged holes near side edges of each external wall through which a strap is passed to encircle said two carrying parts as a girth fastening.

9. The bottle pack container as set forth in claim 8, said ring further comprising two lateral wings, each of said two lateral wings for folding at approximately a right angle to the first fold.

10. The bottle pack container as set forth in claim 8, said frontal wing further comprising a tab located approximately midway along the second fold and extending rearward past the second fold into the internal cut-out, the tab and the frontal wing for securing the ring to the inner surface of the respective external wall.

11. The bottle pack container as set forth in claim 8, wherein each hole is connected through a cut with a side edge of the external wall.

12. The bottle pack container as set forth in claim 11 wherein the strap is passed through the cuts to enter the holes and encircle the two carrying parts.

13. The bottle pack container as set forth in claim 11 wherein each hole is further connected to the side edge through two folds.

14. The bottle pack container as set forth in claim 8 wherein the container is made of one of cardboard and pasteboard.

15. The bottle pack container as set forth in claim 8 wherein each of said two carrying parts includes a plurality of rings.

16. A bottle pack container comprising two carrying parts having central walls which are superimposed to form a central portion, the central portion having a grip, each of the central walls folding to form a bottom wall and an external wall, each external wall folding upward, to be essentially parallel to the central portion, two symmetrically arranged holes near outer edges of the external wall, and a strap running through the holes to encircle the two carrying parts as a girth fastening.

17. The bottle pack container as set forth in claim 16, each respective carrying part of said two carrying parts having a ring cut therein which is connected to the respective carrying part by a first fold, the ring including an internal cut-out, sized to receive a bottle, and a frontal wing bent along second folds, the second folds being essentially parallel to the first fold and being separated by a tab, the bent frontal wing and tab for securing the ring to an inner surface of a respective external wall.

* * * * *